US007372208B1

(12) United States Patent
Olson et al.

(10) Patent No.: US 7,372,208 B1
(45) Date of Patent: May 13, 2008

(54) METHODS AND APPARATUS FOR THERMAL MANAGEMENT OF FLUORESCENT LAMPS

(75) Inventors: Scot Olson, Scottsdale, AZ (US); Bruce Pitman, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/606,562

(22) Filed: Nov. 30, 2006

(51) Int. Cl.
*H01J 7/44* (2006.01)
*H01J 7/24* (2006.01)

(52) U.S. Cl. ..... 315/32; 315/112

(58) Field of Classification Search ..... 315/32, 315/51, 72, 112, 115, 116, 117, 118
See application file for complete search history.

(56) References Cited

U.S. PATENT DOCUMENTS 4,206,501 A * 6/1980 Brooks ..... 362/293
4,978,890 A * 12/1990 Sekiguchi et al. ..... 315/117
5,319,282 A 6/1994 Winsor
5,612,593 A 3/1997 Olson
5,767,934 A * 6/1998 Goddard ..... 349/61
6,118,415 A 9/2000 Olson
6,163,359 A * 12/2000 Smith et al. ..... 349/161
6,876,139 B1 4/2005 Feldman
2006/0221644 A1* 10/2006 Kwon et al. ..... 363/632
2007/0115686 A1* 5/2007 Tyberghien ..... 362/580

* cited by examiner

*Primary Examiner*—Thuy Vinh Tran
(74) *Attorney, Agent, or Firm*—Ingrassia Fisher & Lorenz

(57) ABSTRACT

An assembly for heating a fluorescent lamp (such as the lamp used in a flat panel display) includes a circuit card having a plurality of transistors each configured to produce heat disposed thereon. A thermally-conductive layer is disposed proximate to the plurality of transistors, and the fluorescent lamp is disposed proximate the thermally-conductive layer such that the heat from the transistors is transmitted to the fluorescent lamp via the thermally-conductive layer. By controlling the heat applied to the fluorescent lamp, microclimates in the lamp can be reduced or eliminated, thereby improving the performance of the lamp.

20 Claims, 3 Drawing Sheets

METHODS AND APPARATUS FOR THERMAL MANAGEMENT OF FLUORESCENT LAMPS

TECHNICAL FIELD

The present disclosure generally relates to fluorescent lamp assemblies, and more particularly relates to techniques and structures for managing the temperature of fluorescent lamp assemblies such as those used in liquid crystal displays.

BACKGROUND

A fluorescent lamp is any light source in which a fluorescent material transforms ultraviolet or other lower wavelength energy into visible light. Typically, fluorescent lamps include a glass or plastic tube that is filled with argon or other inert gas, along with mercury vapor or the like. When an electrical current is provided to the contents of the tube, the resulting arc causes the mercury gas within the tube to emit ultraviolet radiation, which in turn excites phosphors coating the inside lamp wall to produce visible light.

Fluorescent lamps have provided lighting in numerous home, business and industrial settings for many years. More recently, fluorescent lamps have been used as backlights in liquid crystal displays such as those used in computer displays, cockpit avionics, flat panel televisions and the like. Such displays typically include any number of pixels arrayed in front of a relatively flat fluorescent light source. By controlling the light passing from the backlight through each pixel, color or monochrome images can be produced in a manner that is relatively efficient in terms of physical space and electrical power consumption.

Despite the widespread adoption of displays and other products that incorporate fluorescent light sources, however, designers continually aspire to improve the amount of light produced by the light source, to make efficient use of electrical power, and/or to otherwise enhance the performance of the light source, as well as the overall performance of the display. In particular, the behavior of many fluorescent lamps can be highly susceptible to variations in temperature and to so-called "microclimates" within the lamp itself. As a result, various techniques for stabilizing the temperature of the lamp and/or for responding to temperature fluctuations have been attempted, with varying degrees of success.

Accordingly, it is desirable to provide devices and techniques for effectively and efficiently managing the temperature of fluorescent lamps. Other desirable features and characteristics will become apparent from the subsequent detailed description of the invention and the appended claims, taken in conjunction with the accompanying drawings and this background of the invention.

BRIEF SUMMARY

Numerous lamp assemblies, displays and techniques are described herein. Various embodiments, for example, provide a fluorescent lamp assembly. The lamp assembly suitably comprises a circuit card having a plurality of transistors disposed thereon that are configured to produce heat. A thermally-conductive layer is appropriately disposed proximate to the plurality of transistors, and a fluorescent lamp is disposed proximate the thermally-conductive layer such that the heat from the plurality of transistors is transmitted to the fluorescent lamp via the thermally-conductive layer.

In other example embodiments, a method of controlling a temperature of a fluorescent lamp is provided. The lamp is appropriately contained within a lamp assembly having a temperature sensor and a plurality of transistors thermally coupled to the fluorescent lamp, and the method comprising the broad steps of determining the temperature of the lamp from a temperature sensor, comparing the temperature with a desired temperature, and activating some or all of the plurality of transistors to thereby produce heat if the temperature is less than the desired temperature. Such techniques may be implemented using conventional analog electronics or other components as appropriate.

Other embodiments include other lamps or displays incorporating structures and/or techniques described herein. Additional detail about various example embodiments is set forth below.

BRIEF DESCRIPTION OF THE DRAWINGS

The present invention will hereinafter be described in conjunction with the following drawing figures, wherein like numerals denote like elements.

DETAILED DESCRIPTION

The following detailed description of the invention is merely example in nature and is not intended to limit the invention or the application and uses of the invention. Furthermore, there is no intention to be bound by any theory presented in the preceding background of the invention or the following detailed description of the invention.

According to various example embodiments, one or more conventional transistors are provided as a heat source to control the temperature of a fluorescent lamp or related assembly. The transistors may be provided, for example, on a face of a printed circuit board (PCB) facing toward the lamp, with a thermally-transmissive layer provided between the transistors and the lamp to transmit and distribute the heat generated by the transistors. Using this structure, the lamp can be warmed to a desired operating temperature and/or subsequently maintained at the desired temperature by varying the activation of one or more heat-producing transistors. By providing heat to the lamp itself, microclimates within the lamp can be avoided, thereby improving lamp performance. Moreover, control of lamp heating and/or cooling can provide additional benefits. In various embodiments, for example, power to the lamp itself may be suppressed during some or all of the initial warming period, thereby allowing for additional power to be provided to the heating structures, and/or for conservation of electrical energy.

Figure 1:
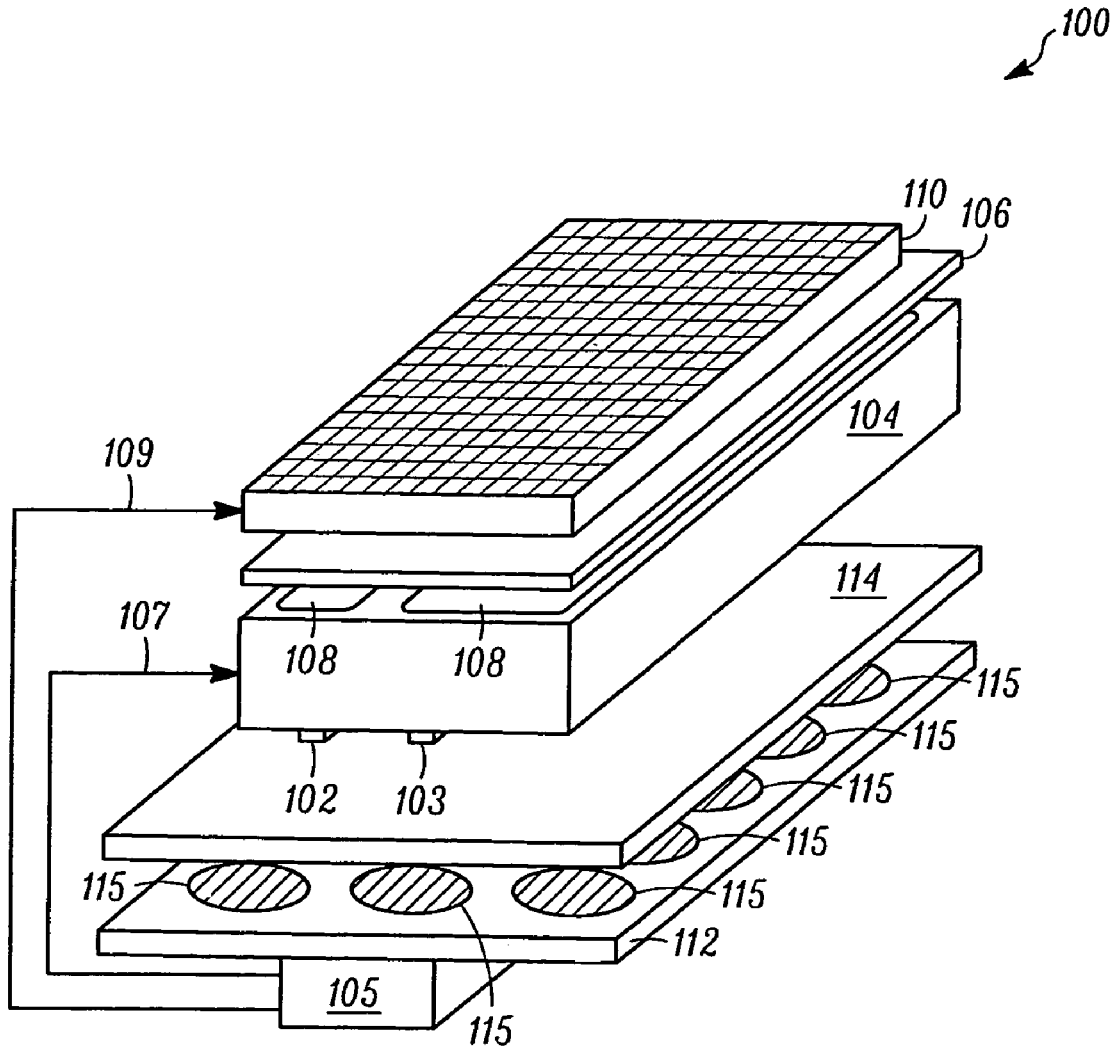
FIG. 1 is an exploded perspective view of an exemplary fluorescent lamp display.

Turning now to the drawing figures and with initial reference to FIG. 1, an example of a flat panel display 100 suitably includes one or more transistors 115 located on a face of a circuit board 112 oriented toward lamp substrate 104. Heat is generated by activating one or more transistors 115, and the generated heat is distributed and transmitted toward lamp substrate 104 by a thermally-transmissive layer 114 as appropriate. By varying the activation of one or more transistors 115, then, the temperature of lamp substrate 104 can be appropriately controlled.

Transistors 115 are any type or types of transistors capable of generating heat in response to an electrical stimulus. In various embodiments, transistors 115 are conventional discrete transistors such as any type of bipolar junction transistor (BJT), field effect transistor (FET) and/or the like. Such devices typically exhibit three or more electrical terminals corresponding to an input terminal (e.g. the collector junction of a BJT or the source terminal of a FET), an output terminal (e.g. the emitter junction of a BJT or the drain terminal of a FET), and a common terminal (e.g. the base junction of a BJT or the gate terminal of a FET). In a typical embodiment, the input terminals of transistors 115 are connected to a battery or other reference voltage and the common terminals are connected to a control source. When the control source activates the common terminal of the transistor 115, the transistor 115 suitably conducts electrical current from the reference toward an electrical ground. The particular numbers and types of transistors 115 used, however, as well as the configurations of particular terminals and signals, may vary significantly from embodiment to embodiment.

Circuit board 112 is any substrate or other structure capable of supporting transistors 115. Typically, circuit board 112 is a conventional printed circuit board (PCB) fashioned from plastic, metal, ceramic or the like using conventional techniques. Circuit board 112 may support any number of discrete or integrated electrical components (e.g. control electronics 105 and/or transistors 115) on either or both opposing faces of the board, and may further include any number of conductive traces interconnecting the various components. Such traces may extend through or around board 112, and/or may include interconnects to separate circuit boards 112 not specifically shown in FIG. 1. Transistors 115, for example, may be activated in response to signals provided directly or indirectly by control electronics 105, or by any other electrical component.

Thermally-conductive layer 114 is any single or multilayer structure capable of transmitting heat produced by transistors 115 toward lamp substrate 104. Such a layer 115 may include any sort of electrically conductive or insulative materials (e.g. metal, ceramic, epoxy and/or the like) arranged in any manner. In various embodiments, layer 114 includes a thermally-transmissive but electrically insulative material disposed near the various transistors 115 in conjunction with a metallic or other conductive layer that distributes heat across the face of substrate 104. An example of such a structure is described in increasing detail in conjunction with FIG. 2 below.

In accordance with conventional display principles, display 100 further includes a backlight assembly with a lamp substrate 104 and a faceplate 106 confining appropriate materials for producing visible light within one or more channels 108. Typically, materials present within channel(s) 108 include argon (or another relatively inert gas), mercury and/or the like. To operate the lamp, an electrical potential is created across the channel 108 (e.g. by coupling electrodes 102, 103 to suitable voltage sources and/or driver circuitry), and the gaseous mercury is excited to a higher energy state, resulting in the release of a photon that typically has a wavelength in the ultraviolet light range. This ultraviolet light, in turn, provides "pump" energy to phosphor compounds and/or other light-emitting materials located in the channel to produce light in the visible spectrum that propagates outwardly through faceplate 106 toward pixel array 110.

The light that is produced by backlight assembly 104/106 is appropriately blocked or passed through each of the various pixels of array 110 to produce desired imagery on the display 100. Conventionally, display 100 includes two polarizing plates or films, each located on opposite sides of pixel array 110, with axes of polarization that are twisted at an angle of approximately ninety degrees from each other. As light passes from the backlight through the first polarization layer, it takes on a polarization that would ordinarily be blocked by the opposing film. Each liquid crystal, however, is capable of adjusting the polarization of the light passing through the pixel in response to an applied electrical potential. By controlling the electrical voltages applied to each pixel, then, the polarization of the light passing through the pixel can be "twisted" to align with the second polarization layer, thereby allowing for control over the amounts and locations of light passing from backlight assembly 104/106 through pixel array 110. Most displays 100 incorporate control electronics 105 to activate, deactivate and/or adjust the electrical parameters 109 applied to each pixel. Control electronics 105 may also provide control signals 107 to activate, deactivate or otherwise control the backlight of the display. The backlight may be controlled, for example, by a switched connection between electrodes 102, 103 and appropriate power sources.

Fluorescent lamp assembly 104/106 may be formed from any suitable materials and may be assembled in any manner. Substrate 104, for example, is any material capable of at least partially confining the light-producing materials present within channel 108. In various embodiments, substrate 104 is formed from ceramic, glass and/or the like. The general shape of substrate 104 may be fashioned using conventional techniques, including sawing, routing, molding and/or the like. Further, channel 108 may be formed and/or refined within substrate 104 by sandblasting in some embodiments.

Channel 108 is any cavity, indentation or other space formed within or around substrate 104 that allows for partial or entire confinement of light-producing materials. In various embodiments, lamp assembly 104/108 may be fashioned with any number of channels, each of which may be laid out in any manner. Serpentine patterns, for example, have been widely adopted to maximize the surface area of substrate 104 used to produce useful light. U.S. Pat. No. 6,876,139, for example, provides several examples of relatively complicated serpentine patterns for channel 108, although other patterns that are more or less elaborate could be adopted in many alternate embodiments. Typically, channel 108 is appropriately formed in substrate 104 by milling, molding or the like, and light-emitting material is applied though spraying or any other conventional technique. The light-emitting material is typically a phosphorescent compound capable of producing visible light in response to "pump" energy (e.g. ultraviolet light) emitted by vaporous materials confined within channel 108. Various phosphors used in fluorescent lamps include any presently known or subsequently-developed light-emitting materials, which may be individually or collectively employed in a wide array of alternate embodiments. The light emitting material may be applied or otherwise formed in channel 108 using any technique, such as conventional spraying or the like.

In operation, then, control electronics 105 suitably provide control signals (e.g. signals 107, 109) to lamp 104, pixel array 110 and/or transistor array 115 to effect heating and/or operation of display 100. By activating some or all of the transistors 115 at appropriate times, lamp substrate 104 can be warmed to a desired temperature to provide stable operation of the display. While the particular operating scheme and layout shown in FIG. 1 may be modified in other embodiments, the basic principals of fluorescent backlighting are applied in many types of flat panel displays 100, including those suitable for use in avionics, desktop or portable computing, audio/video entertainment and/or many other applications.

Figure 2:
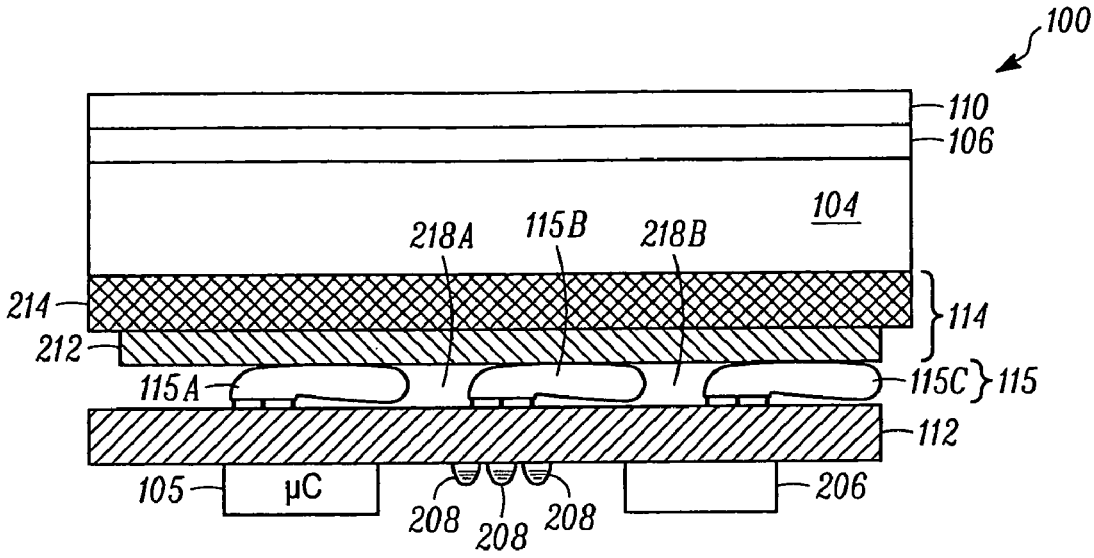
FIG. 2 is a side view of an exemplary fluorescent lamp display.

FIG. 2 shows a cross-sectional side view of an example display 100 similar to that shown in FIG. 1 and described above. Turning now to FIG. 2, display 100 suitably includes a circuit board 112, transistors 115A-C, and thermally-conductive layer 114 as described above. The various transistors 115A-C produce heat in response to the application of appropriate electrical signals, and the generated heat is transmitted to the lamp substrate 104 by conductive layer 114.

In the embodiment shown in FIG. 2, thermally-conductive layer 114 suitably includes two distinct layers 212 and 214 corresponding to an electrically insulating material and an electrically conductive material, respectively, although equivalent embodiments may be fashioned from any number of conducting and/or insulating layers. Insulating layer 212, for example, may be formed from any type of thermally conductive insulating material such as various types of thermally conductive plastic, glass and/or the like. Although FIG. 2 shows layer 212 as a well-formed rigid material extending across the surface of display 100, alternate embodiments may provide any type of plastic or epoxy that is capable of coating the various transistors 115A-C and of filling gaps 218A-B formed between transistors 115A-C. In one exemplary embodiment, insulating layer 212 is formed of resilient RTV (e.g. silicon rubber or the like) that spot bonds the transistors 115 to conductive layer 214; other materials and application techniques may be used in a wide array of alternate embodiments.

The thermally-conductive layer 114 shown in FIG. 2 also includes an electrically conductive layer 214 that contacts with the lamp substrate 104. Conductive layer 214 may be any layer or sheet of metal (e.g. aluminum, tin, copper and/or the like, or any metal alloy) that allows for efficient transfer of heat energy. By providing both an electrically insulating layer 212 and a conducting layer 214, the scheme shown in FIG. 2 provides electrical isolation between transistors 115A-C while still allowing for efficient distribution and transfer of heat from transistors 115A-C to lamp 104. In one embodiment, conductive layer 114 is provided in the form of a flat aluminum plate that is approximately 0.25 inches thick, although the particular materials and dimensions could vary widely in other implementations.

FIG. 2 also shows various components 206, 208 in addition to controller 105 on the face of circuit board 112 opposite transistors 115A-C. The particular electrical components 206, 208 provided will vary significantly from embodiment to embodiment, and, as noted above, additional components may be found on the same side of circuit board 112 as transistors 115, and/or on additional cards or other substrata as appropriate. The various components include drive logic 105 for lamp 104 that may optionally provide drive logic for transistors 115 as well. Alternately, lamp 104 and transistors 115 may be driven by separate control circuitry.

Figure 3:
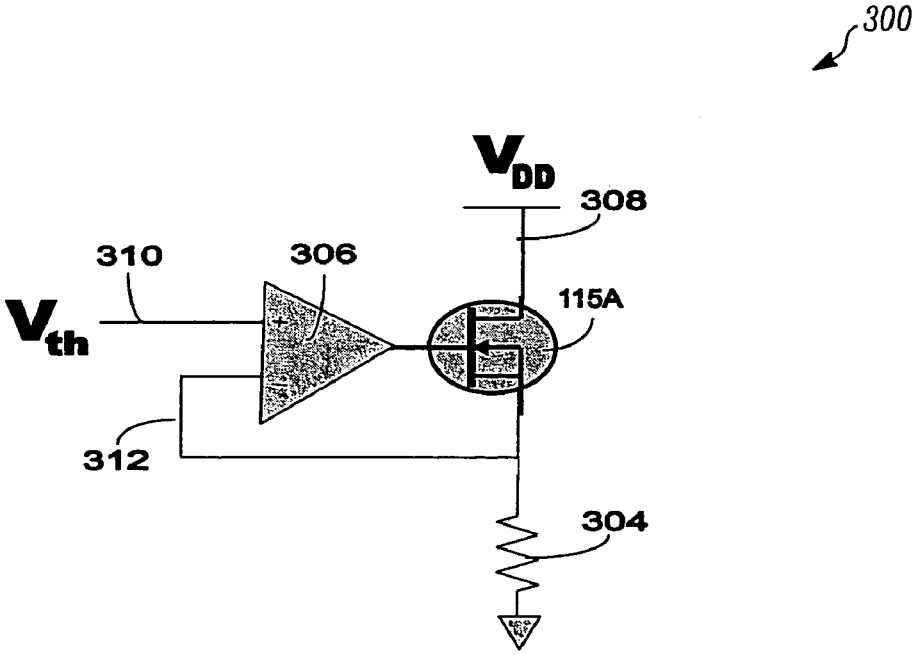
FIG. 3 is a diagram of an exemplary circuit for providing temperature control to a fluorescent lamp.

Turning to FIG. 3, an example analog drive scheme 300 for transistors 115 is shown. The circuit 300 shown in the figure includes an operational amplifier 306 or similar circuit providing an electrical input to the common junction of transistor 115A. The input junction of transistor 115A is coupled (directly or indirectly) to a power source 308, reference voltage, or other known source of electrical energy. The output terminal of transistor 115A is coupled to a resistance 304, and is also provided as a feedback input to amplifier 306. The other input of amplifier 306 is directly or indirectly coupled to a reference source (e.g. a reference voltage) 310 or the like. The negative feedback loop of the amplifier 306 with the current sense resistor 304, determines the power delivered to the transistor 115. Negative feedback with the amplifier holds the voltage across the resistor 304 to the value of the reference voltage 310. Since the sense resistor is relatively small, the voltage drop across it is negligible, and the power delivered to the transistor will be equal to the voltage of the power source 308, times the voltage of the reference 310, divided by the sense resistance. The particular value of the reference voltage 310 varies from embodiment to embodiment, and may be determined empirically or otherwise to correspond to a desired operating temperature. Resistance 304 is fashioned in any manner (e.g. using any sort of discrete, parasitic or other resistance), and is generally designed to be relatively small, although other embodiments may vary widely. Although FIG. 3 shows transistor 115A as an N-type FET, alternate embodiments may use P-type FETs, BJTs, and/or any other types of transistors 115A. These embodiments may involve slight modifications to the circuitry shown in FIG. 3 that can be readily ascertained through conventional electrical engineering principles. Further, circuit 300 may be readily adapted for simultaneous application to two or more transistors 115.

Figure 4:
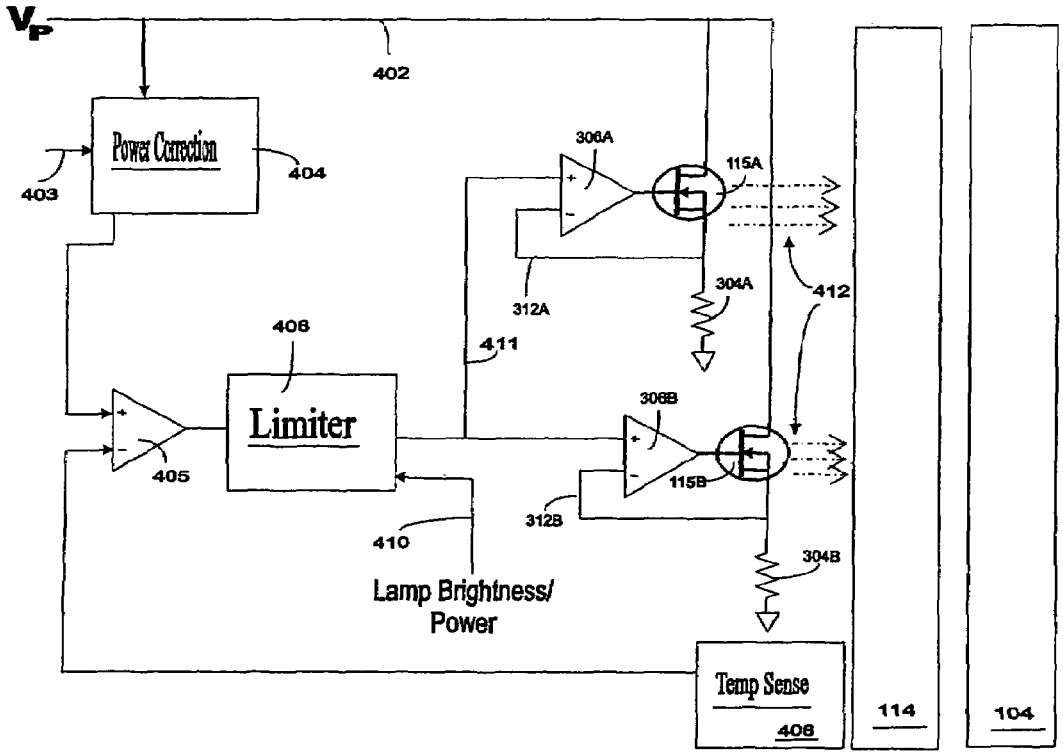
FIG. 4 is a diagram of an alternate circuit for providing temperature control to a fluorescent lamp.

FIG. 4 shows an example of a control circuit 400 that can be used to produce heat in a fluorescent or other lamp 100. With primary reference now to FIG. 4, any number of transistors 115A-B or other heat-producing components are provided in proximity to thermally-conductive layer 114, which transmits heat 412 produced by components 115 to lamp 104. The amount of heat 412 provided by components 115 is appropriately controlled by an electrical and/or electronic network that includes a limiter circuit 408, one or more difference amplifiers 306A-B for each component 115A-B as described above, and/or suitable power correction and error amplifier circuitry 404 and 405, respectively. By scaling a known electrical signal (e.g. voltage 402) in response to current lamp temperature 407, lamp brightness/power 410, control parameters 403 and/or other factors as appropriate, appropriate heat 412 can be produced for transmission to lamp 104.

While FIG. 4 shows transistors 115A-B as N-type FETs, the operation of these devices generally parallels the operation of transistor 115A described with reference to FIG. 3 above. Generally speaking, the drain terminals of the FETs 115A-B are coupled to a battery voltage, power supply rail voltage, or other known signal 402, and the source terminals are coupled to ground or another appropriate reference node via one or more current sensing resistors 304A-B (respectively). In one exemplary embodiment, resistors 304A-B are approximately several tenths of ohms, although other embodiments could use any other values, including parasitic resistance. In the circuit shown in FIG. 4, each transistor 115A-B is activated by simply turning on the common junction of that transistor (e.g. by driving the common junction to a voltage that is greater than the threshold voltage of the device).

FIG. 4 shows an example of an embodiment in which a temperature sensor 406 is present. Temperature sensor 406 is any sort of thermistor or other sensor placed in proximity to lamp 104 to allow determination of the lamp temperature. By obtaining measurements of the lamp temperature in real time (or pseudo-real time or the like), signals 411 applied to heating transistors 115 can be adjusted to increase or decrease the amount of heat applied as appropriate; control of lamp temperature maintained by closed loop action of error amplifier 405.

In the circuit shown in FIG. 4, for example, the temperature of the lamp 104 is determined by sensor 406. Sensor 406 need not be directly coupled to the sensor 104 to perform this determination, and in various embodiments sensor 406 is simply placed on circuit card 112 in proximity to thermally-conductive layer 114. Sensor 406 provides a suitable digital or analog representation 407 of the temperature, such as a voltage signal corresponding to the temperature of the lamp 106 and/or layer 114. This temperature signal 407 is provided to a terminal of an error amplifier 405, and/or otherwise processed as appropriate. The temperature of the lamp can be read in any appropriate manner. Typically, a thermistor or other heat sensor provides a digital or analog reading of the current lamp temperature that can be compared to a threshold or other desired value to determine if additional heating and/or cooling may be desired. In many conventional fluorescent lamps, for example, it may be desirable to operate the lamp at about forty-five degrees Celsius or so to achieve optimum brightness and performance. The actual threshold value may vary from embodiment to embodiment. Further, as noted above, "determining the temperature of a fluorescent lamp" need not be determined directly from the lamp itself, but rather may be inferred from the temperature of conductive layer 114, ambient air within the lamp enclosure and/or any other source as appropriate.

FIG. 4 also shows an optional power correction circuit 404 that provides an appropriate control signal 401. This signal 401 is based upon a known voltage (e.g. reference voltage 402), as adjusted to account for any input signals 403 that may be received from a control interface or the like. By adjusting the signal 401 that is, compared to the temperature reading 407 in error amplifier 405, the amount of heat produced can be optimized for the system.

Further, limiting circuit 408 uses conventional digital and/or analog components to scale the drive signal 411 and/or to otherwise ensure that the drive current provided to the transistors 115A-B does not exceed predetermined limits, a condition that could draw excess battery power, or even theoretically damage the devices or otherwise affect operation of lamp 114. In various further embodiments, a signal 410 is provided to limiter 408 (or another component as appropriate) to increase the tolerances or to otherwise allow additional drive current when the lamp brightness or power is reduced. As the lamp is initially switched on, for example, the lamp is typically too cold for proper operation; as a result, electrical power typically used to power the lamp could instead be provided to the heating elements 115A-B to speed the heating process without exceeding the overall power allocation to the backlight system. As the lamp heats into a temperature range that is more optimal, the lamp can be illuminated and signal 410 can be adjusted to reduce the amount of current provided on signal 411 as appropriate. Moreover, should the actual temperature of the lamp exceed a desired temperature, a suitable cooler 425 such as a fan, thermoelectric cooler and/or the like can be activated.

The control loop operation of amplifiers 405 and 306A-B, as well as circuitry 404 and 408, allows for very accurate control of heating elements 115A-B. Using application of signals 411, transistors 115A-B may be independently or collectively activated with a high level of precision. Operation of the control circuitry can drive the transistors in a linear fashion; a difference in temperature between the lamp and input signal exceeding an amount (e.g. one degree C. or so), for example, could drive the maximum amount of power to the transistors, with this power linearly decreasing to zero as the lamp temperature approaches the control temperature. Rather than focusing on precise control, various equivalent embodiments may operate within "tolerances" wherein no attempt is made to control the temperature precisely, but simply to avoid cooling and/or heating beyond appropriate levels.

Various enhancements or changes could be made to the circuit of FIG. 4. For example, although FIG. 4 shows only two transistor channels for simplicity, in practice any number of transistor channels could be placed in parallel to the two channels shown to increase the amount of heat produced. Further, transistors may be collectively switched using any sort of branching or multiplexing circuitry to extend the logic applied to multiple transistors 115. Alternatively, certain "banks" of transistors 115 may be separately controlled to vary the heating applied to lamp 104, to reduce the number of signal pins 404 consumed, and/or for any other purpose.

While at least one example embodiment has been presented in the foregoing detailed description of the invention, it should be appreciated that a vast number of variations exist. It should also be appreciated that the example embodiment or example embodiments are only examples, and are not intended to limit the scope, applicability, or configuration of the invention in any way. Rather, the foregoing detailed description will provide those skilled in the art with a convenient road map for implementing an example embodiment of the invention. It should be understood that various changes may be made in the function and arrangement of elements described in an example embodiment without departing from the scope of the invention as set forth in the appended claims and their legal equivalents.

What is claimed is:

1. A fluorescent lamp assembly comprising:

a circuit card having a plurality of transistors disposed thereon, wherein each of the plurality of transistors is configured to produce heat;

a thermally-conductive layer disposed proximate to the plurality of transistors; and a fluorescent lamp disposed proximate the thermally-conductive layer such that the heat from the plurality of transistors is transmitted to the fluorescent lamp via the thermally-conductive layer.

2. The fluorescent lamp assembly of claim 1 wherein the thermally-conductive layer comprises a first electrically insulating material proximate to the plurality of transistors.

3. The fluorescent lamp assembly of claim 2 wherein the thermally-conductive layer comprises a second electrically conductive material proximate to the fluorescent lamp.

4. The fluorescent lamp assembly of claim 1 further comprising drive circuitry coupled to the plurality of transistors.

5. The fluorescent lamp assembly of claim 4 wherein the drive circuitry is disposed on the circuit card.

6. The fluorescent lamp assembly of claim 4 wherein the drive circuitry is disposed on a first side of the circuit card and coupled to the plurality of transistors through the circuit card.

7. The fluorescent lamp assembly of claim 4 wherein the drive circuitry comprises at least one operational amplifier having a first input coupled to an output terminal of one of the plurality of transistors, a second input coupled to a reference signal, and an output coupled to a common terminal of the of the one of the plurality of transistors, and wherein the at least one operational amplifier is configured to provide a drive signal to the one of the plurality of transistors in response to a difference between a signal received from the output terminal and the reference signal.

8. The fluorescent lamp assembly of claim 1 wherein the circuit card comprises a first side and a second side in opposition to the first side.

9. The fluorescent lamp assembly of claim 8 wherein the circuit card has a plurality of electronic components disposed on the first side of the circuit card.

10. The fluorescent lamp assembly of claim 9 wherein the plurality of transistors are disposed on the second side of the circuit card.

11. The fluorescent lamp assembly of claim 10 further comprising a cooler configured to activate if the temperature exceeds a threshold temperature.

12. The fluorescent lamp assembly of claim 9 wherein the plurality of electronic components comprise drive circuitry for the plurality of transistors.

13. The fluorescent lamp assembly of claim 12 wherein the plurality of electronic components further comprises drive circuitry for the fluorescent lamp.

14. The fluorescent lamp assembly of claim 1 further comprising a temperature sensor configured to provide a signal indicative of the temperature.

15. A flat panel display comprising the fluorescent lamp assembly of claim 1.

16. A method of controlling a temperature of a fluorescent lamp contained within a lamp assembly having a temperature sensor and a plurality of transistors thermally coupled to the fluorescent lamp, the method comprising the steps of:

determining the temperature of the fluorescent lamp from the temperature sensor;

comparing the temperature with a desired temperature; and if the temperature is less than the desired temperature, activating the plurality of transistors to thereby produce heat.

17. The method of claim 16 further comprising the step of determining if the lamp assembly is in an initial startup mode, and if so reducing a lamp power signal provided to the fluorescent lamp while the lamp assembly remains in the initial startup mode.

18. The method of claim 17 wherein the fluorescent lamp remains in the initial startup mode until the reading of the temperature at least approximates the desired temperature.

19. The method of claim 17 further comprising the step of restoring the lamp power signal provided to the fluorescent lamp while the lamp assembly is no longer in the initial startup mode.

20. The method of claim 16 further comprising the step of activating a cooler if the temperature exceeds the desired temperature.

* * * * *